US008100247B2

(12) United States Patent
Griese

(10) Patent No.: US 8,100,247 B2
(45) Date of Patent: Jan. 24, 2012

(54) MECHANICAL COIN-ACCEPTOR UNIT

(75) Inventor: Roland Griese, Berlin (DE)

(73) Assignee: Walter Hanke Mechanische Werstätten GmbH & Co. KG, Berlin (DE)

( * ) Notice: Subject to any disclaimer, the term of this patent is extended or adjusted under 35 U.S.C. 154(b) by 95 days.

(21) Appl. No.: 12/705,662

(22) Filed: Feb. 15, 2010

(65) Prior Publication Data

US 2010/0206690 A1 Aug. 19, 2010

(30) Foreign Application Priority Data

Feb. 17, 2009 (DE) ..... 10 2009 009 607

(51) Int. Cl.
*G07F 1/04* (2006.01)

(52) U.S. Cl. ..... 194/335; 194/344; 453/14; 209/676

(58) Field of Classification Search ..... 194/335, 194/344; 453/14; 209/632, 633, 635, 660, 209/668, 676, 677, 679
See application file for complete search history.

(56) References Cited

U.S. PATENT DOCUMENTS 3,896,916 A * 7/1975 Ruzic et al. ..... 194/335

* cited by examiner

*Primary Examiner* — Mark Beauchaine
(74) *Attorney, Agent, or Firm* — Matthew B. Dernier, Esq.; Ginson & Dernier LLP

(57) ABSTRACT

There is proposed a mechanical coin-acceptor unit with a coin running channel which has a running rail for rolling a coin, in or on which testing arrangements for testing the properties of the rolling coin are provided, having a coin-acceptor shaft and a return shaft disposed below the running rail, where the running rail is mounted on a basic body and has a recess in the running direction of the coin for testing the thickness of the coin which falls possibly through the recess into the return shaft, and the running rail is mounted rotatably on the basic body via a point of rotation.

6 Claims, 5 Drawing Sheets

MECHANICAL COIN-ACCEPTOR UNIT

BACKGROUND

The invention relates to a mechanical coin-acceptor unit according to the preamble of the main claim.

A large number of mechanical coin-acceptor units which have a coin running channel connected to a coin slot are known in the state of the art, a plurality of sensors which examine an inserted coin for its genuineness and permissibility being disposed in the region of the coin running channel. The sensors or testing units check for example the dimensions of the coins, their weight and their metallic properties. In order to test the dimensions, delimitations are provided by rails or the like which take into account the diameter or the thickness, the weight is tested by at least one set of scales which is connected to an ejector and the metallic properties are tested by at least one magnet which is disposed on the coin channel.

The coin channel is delimited by a lower running rail on which the coin rolls, it being supported by its upper edge on a rail for prescribing the size. If the coin is too small, it falls through under this rail and passes into a return channel provided below the running rail. In the running rail, a recess or groove is incorporated in the longitudinal direction, i.e. in the running direction of the coin, which recess or groove, together with an abutting flap, prescribes a gap which serves to test the thickness of the coins. If a coin is too thin, then it slides into this recess or this gap and is jammed there or falls into the return channel situated thereunder. The jammed coins can be freed externally by pivoting the flap.

Normally, the basic body and the flap connected pivotably to the basic body are produced in the injection moulding process and the running rail which is configured as a stamped part is connected rigidly to the basic body. Since the flap and/or the basic body can have unevennesses or can be distorted as a result of production or due to transport or the like, adjusting and straightening operations are undertaken manually during assembly of the coin-acceptor unit, with which operations a possible distortion is compensated for in order that no faults can occur in the measurement of the thickness, if for example the flap does not abut correctly against the running rail or against both supports of the running rail and a one-sided opening angle between flap and running rail is present. Such adjusting and straightening operations are however time-consuming and hence increase the costs of a mechanical coin-acceptor unit.

SUMMARY

The object therefore underlying the invention is to improve a coin-acceptor unit in that straightening and adjusting operations for determining the gap for the thickness measurement are avoided and a reliable measurement of the thickness of a coin is ensured.

This object is achieved according to the invention by the characterising features of the main claim in conjunction with the features of the preamble. As a result of the measures indicated in the sub-claims, advantageous developments and improvements are possible.

As a result of the fact that the running rail is mounted rotatably on the basic body via a point of rotation, the running rail can abut reliably on both sides of the recess against the flap, even with distortion of the flap or of the basic body relative to the flap due to fabrication tolerances and/or external influences during transport, so that the gap formed between running rail and flap is defined and a reliable thickness test is allowed. The point of rotation or rotation axis is arranged vertically to the running rail and in longitudinal direction of the running rail between the support points or support regions, at which the flap abuts against the running rail and which are arranged on both sides of the recess. If the flap and the basic body are distorted relative to each other, the distortion is compensated by the rotation of the running rail.

It is particularly advantageous that the support points of the running rail, which abut against the flap, have an essentially punctiform configuration so that no tiltings occur, the point-like mounting being achieved in that the running rail is provided on both sides of the recess, viewed in the running direction of the coin, with a radius, as a result of which the support points adapt to a distortion and the flap forms a tangent to the radius and abuts respectively in a punctiform manner.

Furthermore, in an advantageous embodiment, incisions are provided in the flap in the region of the support points and are configured such that the edge of the plate-like running rail, which is inclined in the running direction of a coin and transversely relative to the running direction of a coin, comes to abut in a parallel manner. This prevents, on the one hand, the edge from being incorporated in an uncontrolled manner in the surface of the flap if no incision were present and, on the other hand, it is unnecessary in addition to machine the edge of the running rail in order to avoid incorporation, for example by means of a sheet metal cutting tool, in which the running rail would require to be clamped.

BRIEF DESCRIPTION OF THE DRAWINGS

An embodiment of the invention is represented in the drawing and is explained in the subsequent description in more detail. There are shown.

DETAILED DESCRIPTION OF THE INVENTION

Figure 1:
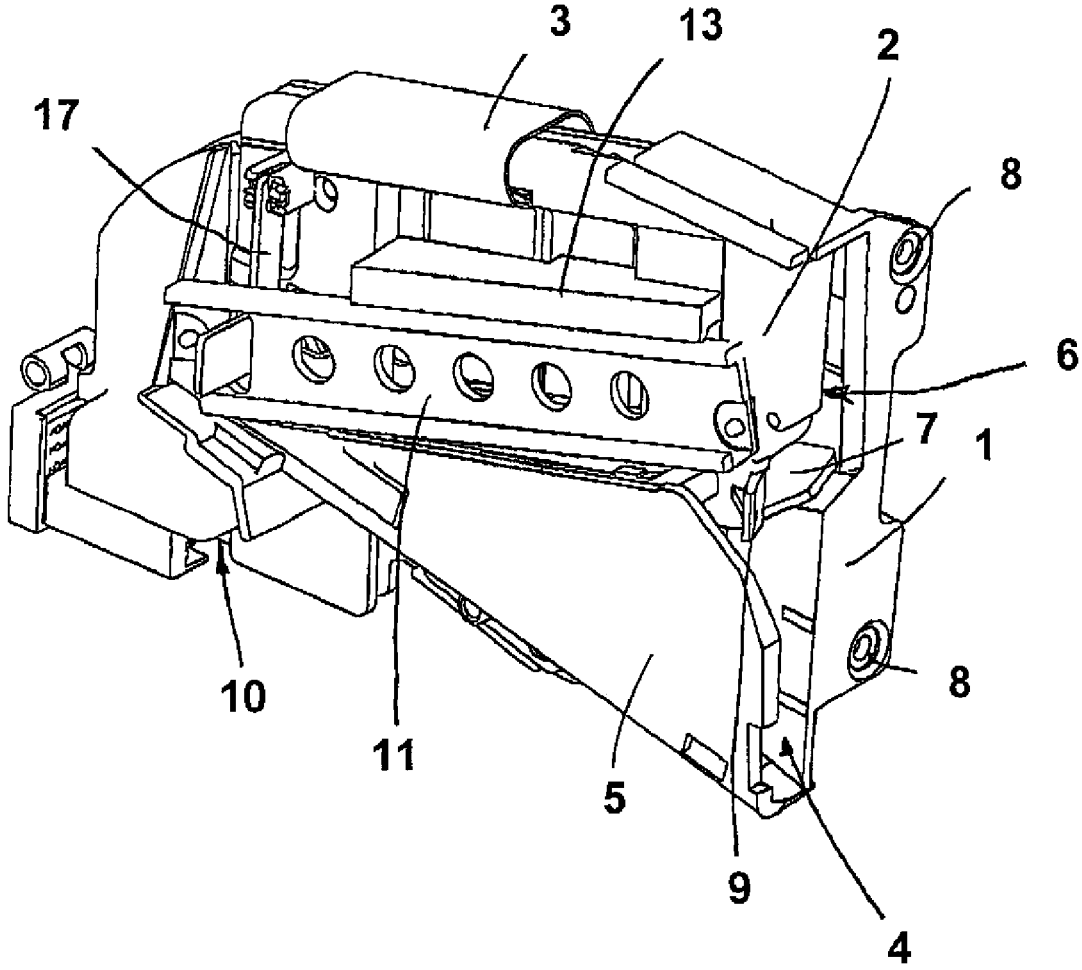
FIG. 1 is a perspective representation of the coin-acceptor unit according to the invention, viewed from one side.
Figure 2:
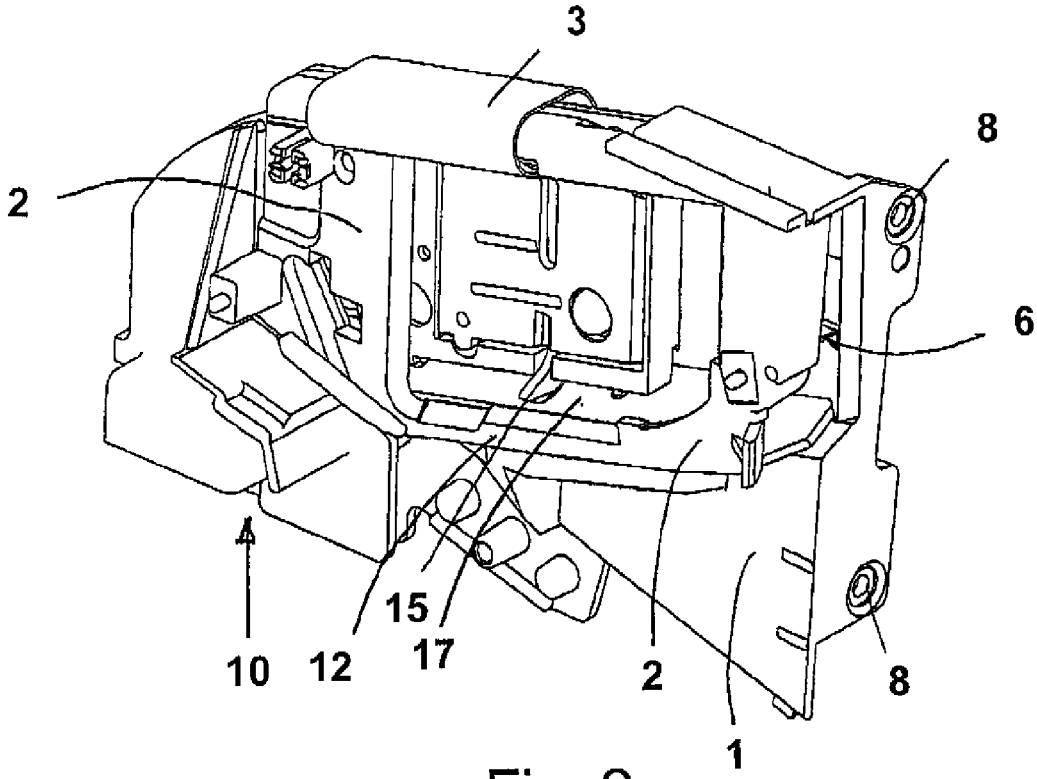
FIG. 2 is a view according to FIG. 1 in which the moulded part fitted on the flap for the size measurement is omitted, just as a part of the return channel, for the sake of better visibility.
Figure 3:
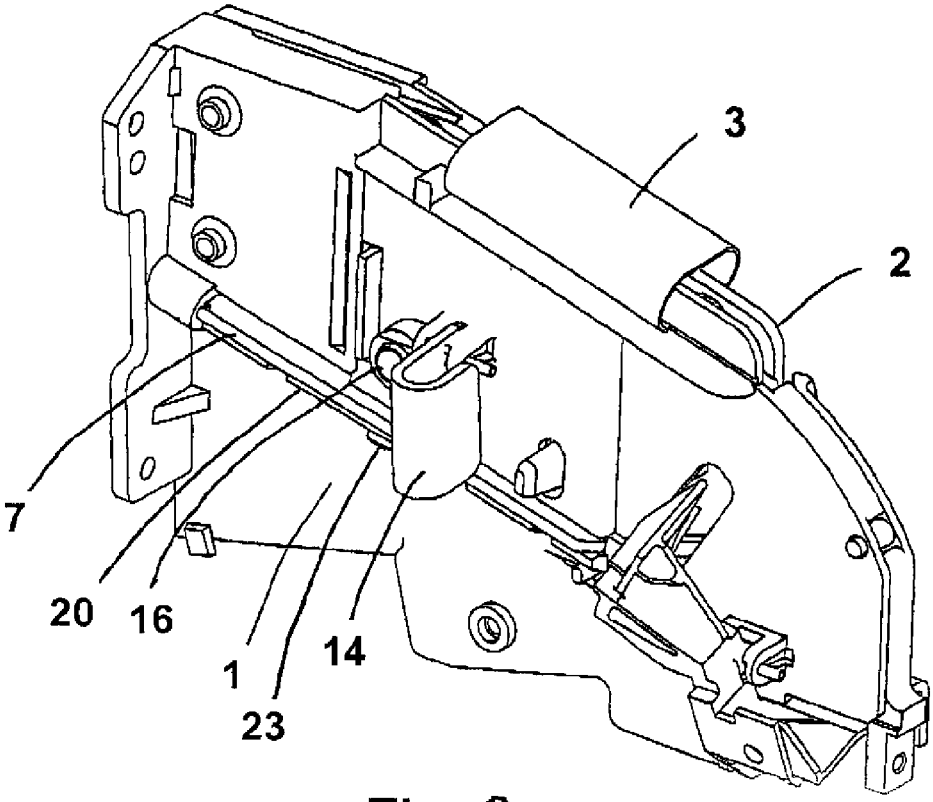
FIG. 3 is a perspective view of the coin-acceptor unit from the side opposite to FIG. 1, FIGS. 4*a*-4*b* show views on the basic body and the flap when the coin-acceptor unit is opened out.

The mechanical coin-acceptor unit represented in FIGS. 1 to 3 has a basic body 1 on which a flap 2 is mounted pivotably with the help of a flat spiral spring 3, the flap being shown open in the central region in FIG. 2 for a better view. Furthermore, a return channel 4 is provided below the flap 2, which return channel is delimited, on the one hand, by the basic body 1 and, on the other hand, by a diecast part 5 which is mounted resiliently on the basic body 1 and has an L-shaped configuration in cross-section. A plurality of testing elements which are explained in more detail in the subsequent description are provided on the basic body 1.

There is defined between basic body 1 and flap 2 a coin running channel 6 which is delimited at the bottom by a running rail 7 which is inclined diagonally in the running direction of a coin and transversely relative to the running direction. The coin running channel 6 is accessible from the outside via a coin insertion slot provided in a front plate (not illustrated), the basic body 1 being connected to the front plate via borings 8. The flap 2 can be pivoted from outside via a control button (not illustrated) provided in the front plate which can slide, with a cone or the like, along on a diagonal surface 9 moulded on the flap. The coin running channel 6 opens into a coin-acceptor shaft 10 for permissible and recognised coins which have passed through the various testing devices.

A rail 11 which serves to deflect a rejected coin from the coin channel into the return channel 4 is mounted on the flap, corresponding to FIG. 1. This rail 11 is disposed such that a spacing which increases in the running direction exists between said rail and the lower edge 12 of the flap 2 (see FIG. 2). Furthermore, an element 13 for testing the diameter of an inserted coin is mounted on the rail 11 and runs along in the coin channel with the correct size on an edge of the element 13. If however the coin is too small it tilts against the rail 11 and is conducted by the latter into the return channel 4.

As can be detected in FIG. 3, a set of scales 14 is mounted pivotably on the basic body 1, said scales being configured in the present case as a metal sheet bent in a U-shape and being in communication with an ejector 15 (see FIG. 2), a coin guided through the coin running channel 6 being ejected by the ejector 15 into the return channel 4 if it is too light. Furthermore, at least one magnet 16 is mounted in the basic body and tests the magnetic properties of an inserted coin, the coins tested by the coin-acceptor unit being slightly magnetic and being retained by the magnet 16 on the running rail 7. Finally, also various blocking elements are provided against manipulation from outside, thus a blocking pendulum 17 is mounted pivotably on the flap 2 and pivots into the coin channel 6 when the flap 2 is opened.

Figure 4:
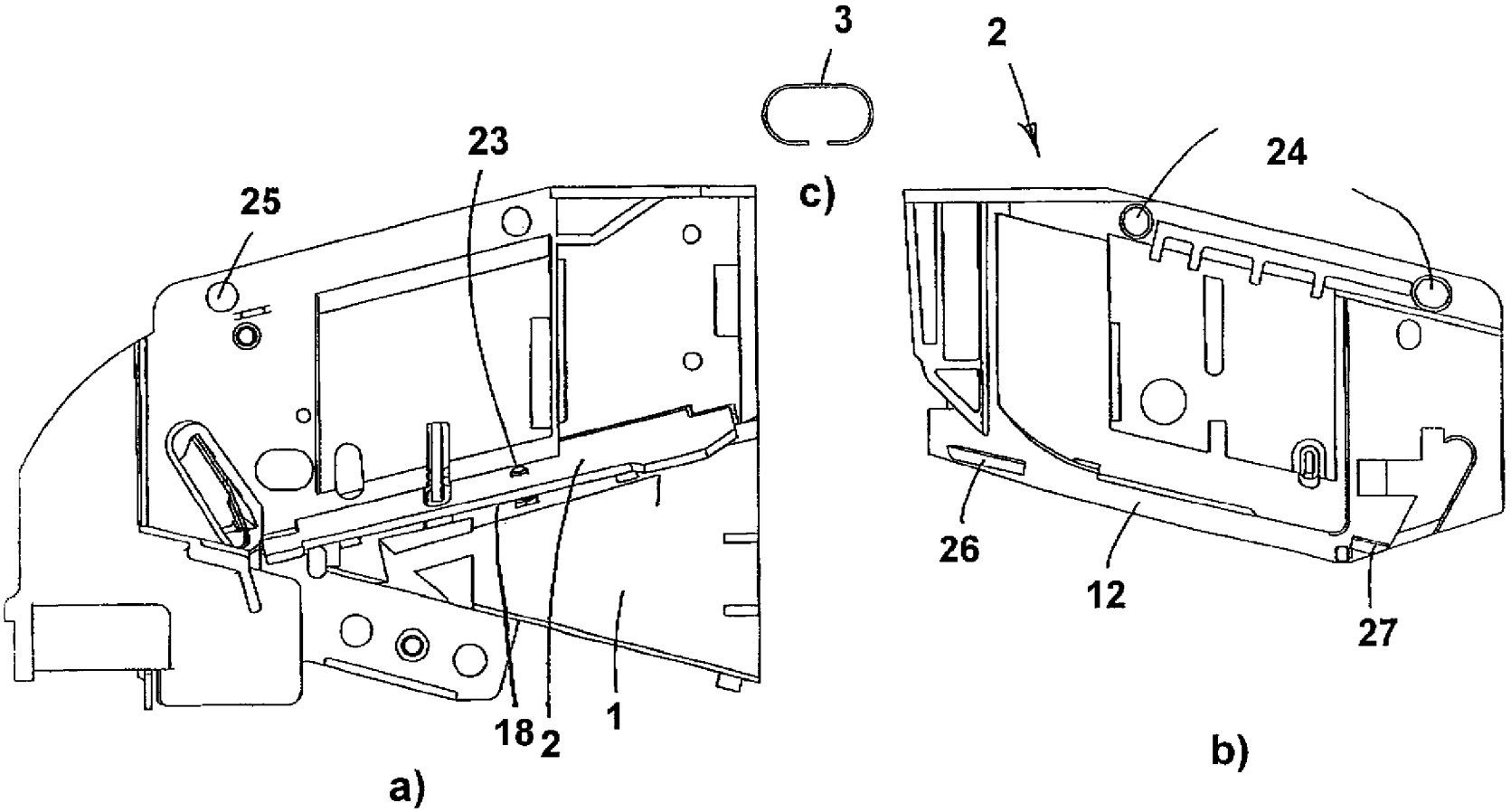

In FIGS. 5*a*) and 5*b*), the running rail is represented in the view thereof. The running rail 7 is configured as a sheet metal stamped part and has, over a part of its length, a recess 18 which can be detected likewise in FIG. 4*a*) and shows the basic body part of an opened-up coin-acceptor unit with running rail 7.

Figure 5:
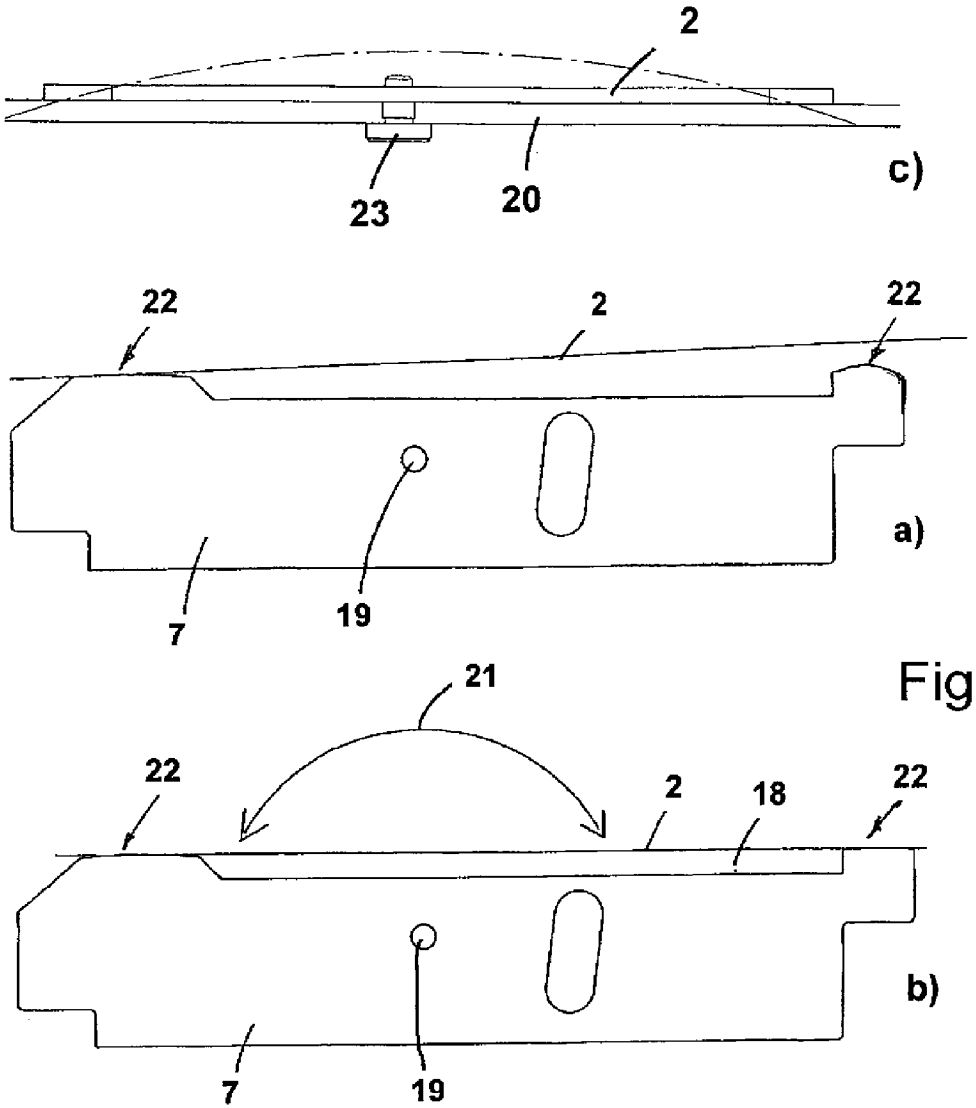
FIG. 5 is a view on a running rail with flap (a), (b) indicated and a side view of the running rail with attachment screw and rail-like projection of the basic body (c)

In FIG. 5, the flap 2 is represented schematically by a line and FIG. 5*a*) is intended to show schematically that the flap 2 is slightly distorted and would not abut against the running rail if the latter were connected rigidly to the basic body 1. The recess 18, together with the flap 2, provides in fact a longitudinal gap which is provided over a part of the coin running channel corresponding to the recess 18 in the running rail and via which a thickness test of a coin inserted into the coin channel is undertaken. In the case according to FIG. 5*a*), a false thickness measurement would be undertaken. In order to avoid this false thickness measurement, the running rail 7 is connected via a point or axis of rotation 19 to a rail-like projection 20 moulded on the basic body 1 such that, when the flap 2 abuts against the running rail 7, the running rail 7 pivots about the point of rotation 19 such that the desired gap is prescribed. This is indicated in FIG. 5*b*) by the double arrow 21. The support regions of the running rail 7, with which these can abut against the flap 2 or vice versa, are designated with 22. The support regions 22 are preferably provided with slight radii, as can be detected in particular in FIG. 5*a*), as a result of which a spherical support position respectively is formed and the support point is consequently punctiform or extends linearly over the thickness of the running rail 7. This avoids tilting, i.e. a defined support point is made available.

Preferably, the point of rotation 19 is formed by a screw which comprises a threadless collar connected to the screw head and a threaded part which is screwed together with the running rail 7. The collar thereby engages through the rail-like projection 20 on the basic body 1 and allows slight rotation of the running rail 7. Such a screw 23 can be detected in FIG. 3 and FIG. 4 and also in section according to FIG. 7.

In order to ensure in addition that the gap formed by the recess 18 and the lower edge 12 of the flap 2 is not too large due to production errors, the flap 2 in the region of the recess 18, i.e. at the lower edge 12, can be provided with a slight curve from the start in the direction of the recess 18. This means that the gap width is not constant but over the entire length of the recess 18 is partially, i.e. in the centre, narrower, it must be ensured overall that the measuring dimension is provided in as large a region possible as possible. For example, the gap widths should be tapered, in the ideal case, over the length of the recess 18 by approx. 50 mm and at most 0.05 mm.

In FIG. 5*c*) a side view of the running rail 7 with attachment screw 23 and the rail-like projection 20 on which it is mounted is represented. A slightly arcuate running rail 7 (arc opposite to the projection 20), as indicated in broken lines, is advantageous since it is ensured therewith that the ends of the running rail 7 are supported on the rail-like projection and hence a slight tension is produced when tightening the running rail 7 by means of the attachment screw 23. The manufacturing tolerances for the attachment screw 23 are thereby compensated for and tilting of the running rail in all directions is avoided. Preventing the tilting is important in order to ensure the diameter measurement.

Figure 7:
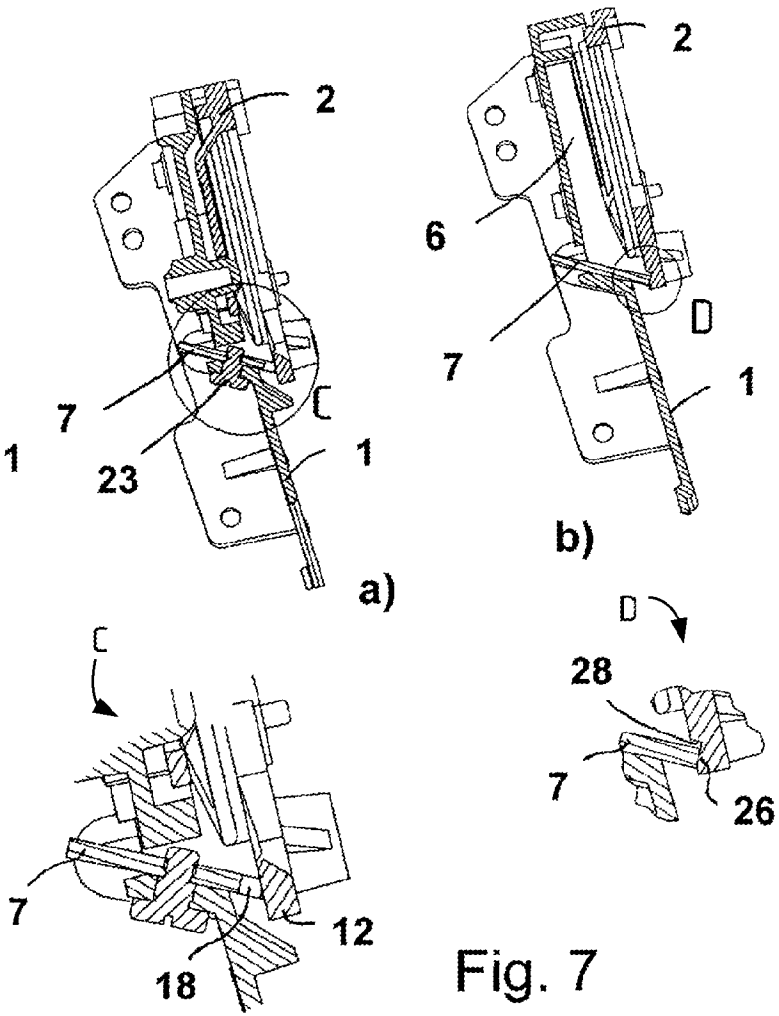
FIG. 6 is a view corresponding to FIG. 2 with section lines and FIGS. 7*a*-7*b* are sections corresponding to section line A-A and to section line B-B, respectively, of FIG. 6. The detail of echoed areas C and D of FIGS. 7*a* and 7*b*, respectively, are enlarged by about 2:1.
Figure 6:
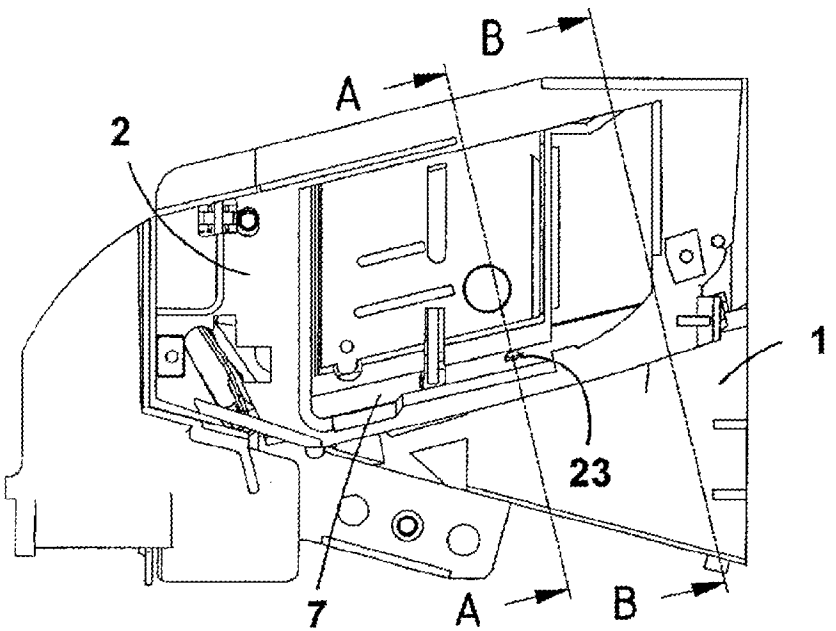

In FIG. 4*b*) the flap 2 is represented from inside, i.e. directed towards the basic body 1, reference being made to punctiform depressions 24 for the sake of completeness, which depressions are in engagement with corresponding nipple-like raised portions 25 provided on the basic body, this connection 24, 25, together with the oval flat spiral spring 3, illustrated in FIG. 4*c*), which is spread over the upper edge of the flap 2 and of the basic body 1, form the pivot point of the flap 2. In the lower edge 12 of the flap 2, support points 26, 27 which are intended to abut against the support regions 22 of the running rail 7 can be detected. The support points 26, 27 can be detected in more detail in FIG. 7 and here in particular in the detail according to FIG. 7*b*), FIG. 7 showing respectively a section corresponding to the section lines A-A and B-B illustrated in FIG. 6. FIG. 6 otherwise corresponds to FIG. 2 so that no additional explanation is required here.

FIG. 7*a*) is a section through the point of rotation of the running rail 7 which is prescribed by the screw 23. The detail C shows the recess 18 of the running rail 7 and it can be detected that the edge of the running rail 7 abuts against the lower edge 12 of the flap 2. How the edge abuts, can be detected in FIG. 7*b*). For this purpose, the flap 2 has an angular recess 28 which is chosen such that the edge of the running rail is essentially parallel to the long side of the recess 28. Since the support regions of the running rail, as described above, are provided with a radius, the support, viewed from above, is punctiform or linear over the edge of the running rail. Because of the recess 28, incorporation of the edge in the flap 2 is avoided.

The invention claimed is:

1. A mechanical coin-acceptor unit, comprising:

a coin running channel which has a running rail for rolling a coin and in or on which testing arrangements for testing the properties of the rolling coin are provided, the running rail being mounted on a basic body and having a longitudinal recess in a running direction of the coin for testing a thickness of the coin which may fall through the longitudinal recess depending on the thickness of the coin, a coin-acceptor shaft and a return shaft disposed below the running rail, the longitudinal recess communicating with the return shaft such that the coin may fall through the longitudinal recess into the return shaft, and a flap connected pivotably to the basic body and forming a component of the coin running channel, wherein the running rail is mounted rotatably on the basic body via a point of rotation which is arranged between support points of the flap and the running rail on both sides of the recess such that the flap securely abuts against the running rail on both sides of the recess.

2. The mechanical coin-acceptor unit according to claim 1, wherein the support points of the running rail which abut against the flap have an essentially punctiform configuration when viewed along the running rail.

3. The mechanical coin-acceptor unit according to claim 2, wherein the running rail, on both sides of the recess viewed in the running direction, is provided with a radius in order to form essentially punctiform support points in a view on the running rail.

4. The mechanical coin-acceptor unit according to claim 1, wherein the running rail is inclined in the running direction of the coin and transversely relative to the running direction of the coin and the recess is provided for abutment parallel to an edge of the running rail in the flap proximate to the support points.

5. The mechanical coin-acceptor unit according to claim 1, wherein the flap is provided with an arcuate curve proximate to the recess such that a gap formed by the recess and the flap, viewed over the length, is narrower in the central region than at end regions of the gap.

6. The mechanical coin-acceptor unit according to claim 5, wherein the width of the gap formed by the recess and the flap varies at most by 0.05 mm relative to the length of approx. 50 mm.

* * * * *